US011203915B2

(12) United States Patent
Kelley et al.

(10) Patent No.: US 11,203,915 B2
(45) **Date of Patent: *Dec. 21, 2021**

(54) LOW FLUID LEVEL VALVE

(71) Applicant: TAM INTERNATIONAL, INC., Houston, TX (US)

(72) Inventors: Caleb Kelley, Houston, TX (US); Eugene Resweber, Houston, TX (US); Nathaniel Harris, Houston, TX (US); Reid Poynor, Houston, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 36 days.

This patent is subject to a terminal disclaimer.

(21) Appl. No.: 16/809,331

(22) Filed: Mar. 4, 2020

(65) Prior Publication Data

US 2020/0199969 A1 Jun. 25, 2020

Related U.S. Application Data

(63) Continuation of application No. 15/575,570, filed as application No. PCT/US2017/017675 on Feb. 13, 2017, now Pat. No. 10,619,447.

(60) Provisional application No. 62/302,602, filed on Mar. 2, 2016, provisional application No. 62/295,383, filed on Feb. 15, 2016.

(51) Int. Cl.
*E21B 34/06* (2006.01)
*E21B 33/127* (2006.01)
*E21B 34/10* (2006.01)

(52) U.S. Cl.
CPC ..... *E21B 34/063* (2013.01); *E21B 33/127* (2013.01); *E21B 34/10* (2013.01)

(58) Field of Classification Search
CPC ..... E21B 33/127; E21B 34/14; E21B 34/142; E21B 34/063; E21B 34/10
See application file for complete search history.

(56) References Cited

U.S. PATENT DOCUMENTS 4,237,979 A * 12/1980 Weise ..... E21B 23/06 166/120

* cited by examiner

*Primary Examiner* — Catherine Loikith
(74) *Attorney, Agent, or Firm* — Locklar PLLC

(57) ABSTRACT

A valve collar for a downhole packer includes a flow path. The flow path includes an opening valve and closing valve. The valve collar further includes a lockout valve piston. The lockout valve piston is positioned such that in an unset position, the flow path is open and in a set position, the flow path is blocked by the lockout valve piston. The lockout valve piston may be adapted to be shifted from the unset position to the set position by a pressure spike inside the valve collar. The lockout valve piston may be held in the unset position by a temporary restraint.

18 Claims, 6 Drawing Sheets

LOW FLUID LEVEL VALVE

CROSS-REFERENCE TO RELATED APPLICATIONS

This application is a continuation of U.S. application Ser. No. 15/575,570, filed Nov. 20, 2017, which is a National Stage Entry of PCT/US2017/17675, filed Feb. 13, 2017; which itself claims priority from U.S. provisional application No. 62/295,383, filed Feb. 15, 2016 and U.S. provisional application No. 62/302,602, filed Mar. 2, 2016. The entireties of PCT/US2017/17675, U.S. 62/295,383, and U.S. 62/302,602 are incorporated herein by reference.

TECHNICAL FIELD/FIELD OF THE DISCLOSURE

The present disclosure relates to valve arrangements for downhole tools.

BACKGROUND OF THE DISCLOSURE

Fluid-energized, or inflatable, packers are isolation devices used in a downhole wellbore to seal the inside of the wellbore or a downhole tubular. They rely on elastomeric bladders to expand and form an annular seal when inflated by fluid pressure. Typically, inflatable packers are controlled by packer valves. Various configurations of packer valves have been devised, including two-valve controlled packers in which one valve is used to inflate the packer and the other is used to regulate the maximum pressure applied to the packer.

However, in the event that the inflatable packer fails, current two-valve controlled packers may be unable to close off the packer fill port. Pressure within the tubular may cause unrestricted fluid flow through the packer fill port into the surrounding annulus. This flow may lead to damage to the downhole tool. In addition, an undesired communication path to the surrounding annulus may remain open.

SUMMARY

A fluid actuated packer and collar assembly is disclosed herein. The fluid actuated packer and collar assembly includes a packer having a packer body. A valve assembly is fluidly coupled to the packer body. The valve assembly includes an opening valve. The opening valve includes an opening valve cylinder and an opening valve piston. The opening valve has a closed position wherein the opening valve piston is mechanically coupled to a first temporary restraint and the opening valve piston closes a flow path between an interior of a mandrel and a first connecting port. The opening valve has an open position wherein the flow path between the interior of the mandrel and the first connecting port is open. The valve assembly includes a closing valve. The closing valve includes a closing valve cylinder and a closing valve piston. The closing valve has an open position wherein the closing valve piston is mechanically coupled to a second temporary restraint and a flow path between a second connecting port and the packer body is open. The closing valve has a closed position wherein the closing valve piston closes the flow path between the second connecting port and the packer body. The valve assembly includes a lockout valve. The lockout valve includes a lockout valve cylinder and a lockout valve piston. The lockout valve has an open position wherein the lockout valve piston is mechanically coupled to a third temporary restraint and a flow path between the first connecting port and the second connecting port is open. The lockout valve has a closed position wherein the lockout valve piston closes the flow path between the first connecting port and the second connecting port.

A method is disclosed herein. The method includes positioning a packer and collar assembly in a wellbore. The packer and collar assembly includes a packer. The packer includes a packer body. A valve assembly is fluidly coupled to the packer body. The valve assembly includes an opening valve. The opening valve includes an opening valve cylinder and an opening valve piston. The opening valve has a closed position wherein the opening valve piston is mechanically coupled to a first temporary restraint and the opening valve piston closes a flow path between an interior of a mandrel and a first connecting port. The opening valve has an open position wherein the flow path between the interior of the mandrel and the first connecting port is open. The first temporary restraint has a first breaking force corresponding to a first selected threshold pressure acting on the opening valve piston. The valve assembly includes a closing valve. The closing valve includes a closing valve cylinder and a closing valve piston. The closing valve has an open position wherein the closing valve piston is mechanically coupled to a second temporary restraint and a flow path between a second connecting port and the packer body is open. The closing valve has a closed position wherein the closing valve piston closes the flow path between the second connecting port and the packer body. The second temporary restraint has a second breaking force corresponding to a second threshold pressure acting on the closing valve piston. The valve assembly includes a lockout valve. The lockout valve includes a lockout valve cylinder and a lockout valve piston. The lockout valve has an open position wherein the lockout valve piston is mechanically coupled to a third temporary restraint and a flow path between the first connecting port and the second connecting port is open. The lockout valve has a closed position wherein the lockout valve piston closes the flow path between the first connecting port and the second connecting port. The third temporary restraint has a third breaking force corresponding to a third threshold pressure acting on the lockout valve piston. The method includes increasing the pressure in the interior of the mandrel above the first selected threshold pressure; thereby, breaking the first temporary restraint and opening the opening valve. The method includes flowing fluid through the valve assembly from the interior of the mandrel to the packer body through the first connecting port and the second connecting port; thereby, inflating the packer body.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
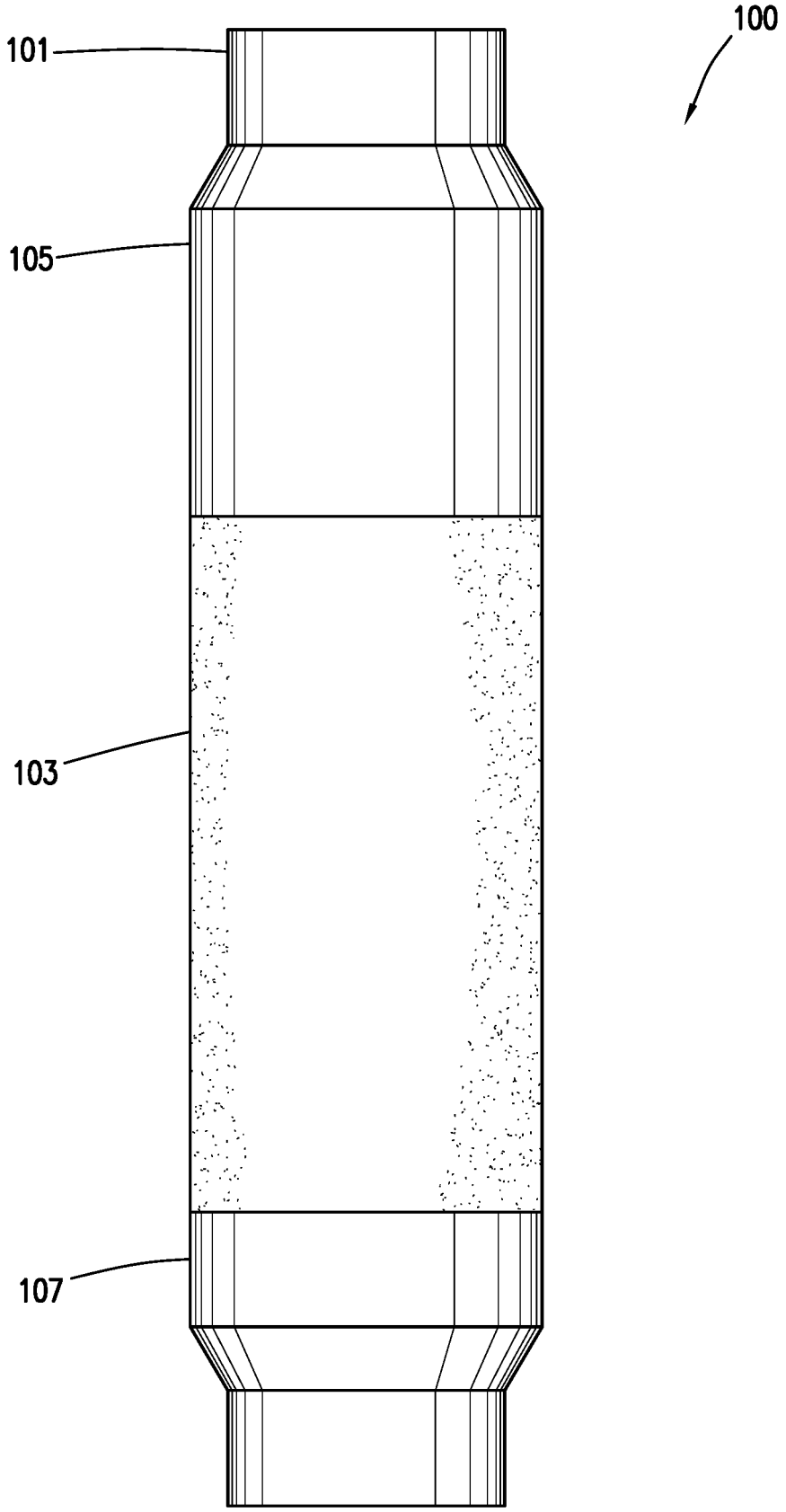
FIG. 1 depicts a side view of a packer consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a packer assembly 100 consistent with at least one embodiment of the present disclosure. Packer assembly 100 may include mandrel 101, packer body 103, and valve collar 105. Packer body 103 and valve collar 105 may be positioned on an outer surface of mandrel 101. Packer body 103 may be held to mandrel 101 by one or more packer heads 107. Packer body 103 may be an elastomeric body adapted to engage the walls of a surrounding tubular or wellbore when a fluid is introduced between mandrel 101 and packer body 103. Fluid used to inflate packer body 103 may enter packer body 103 through one or more inflation ports formed between the interior (not shown) of mandrel 101 and packer body 103. Valve collar 105 may include one or more valve assemblies that define a fluid path between the interior of mandrel 101 and packer body 103, as described herein below, to regulate fluid flow into packer body 103.

Figure 2:
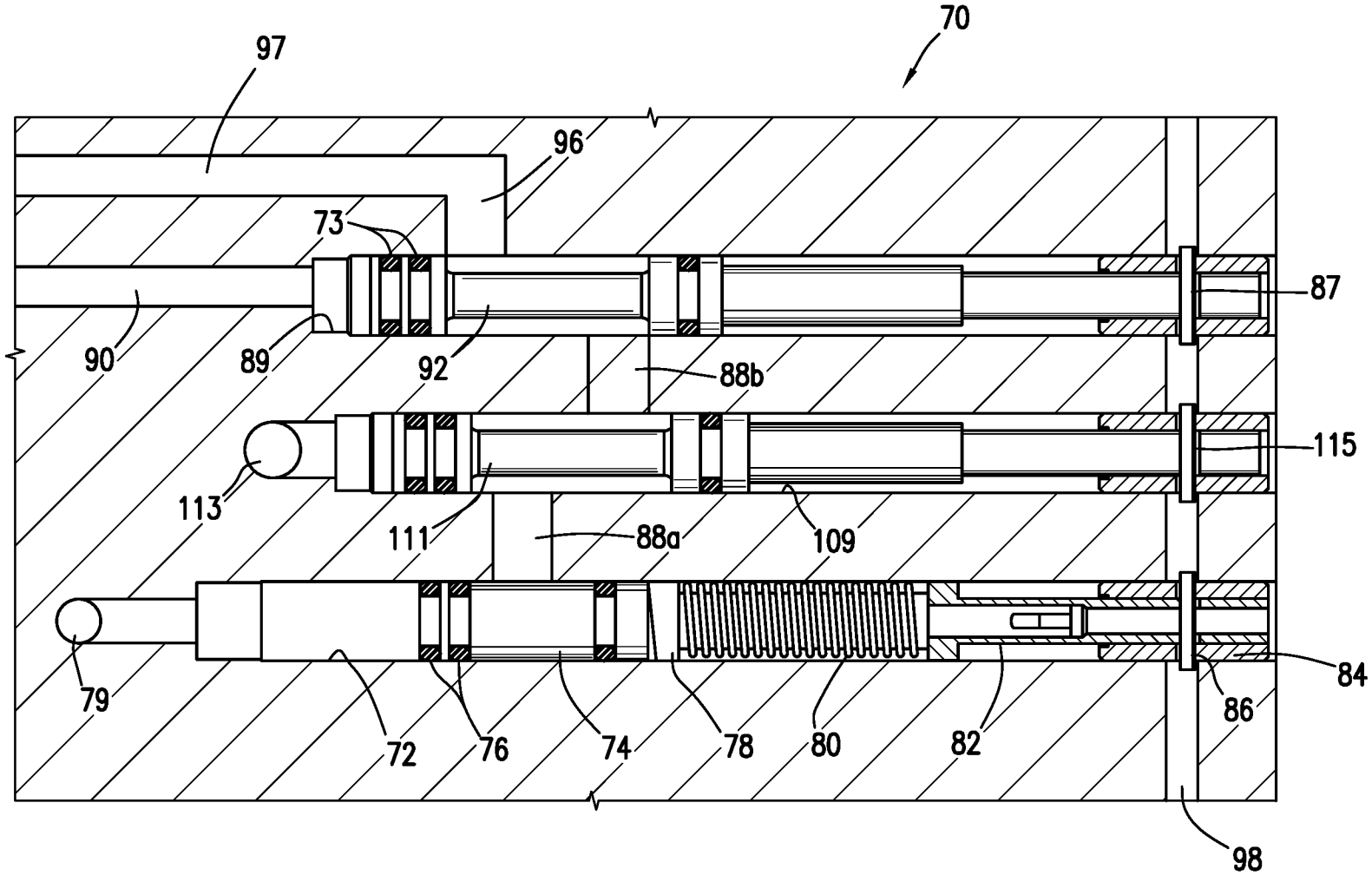
FIG. 2 depicts a valve arrangement for a downhole tool consistent with at least one embodiment of the present disclosure in a run-in position.
Figure 3:
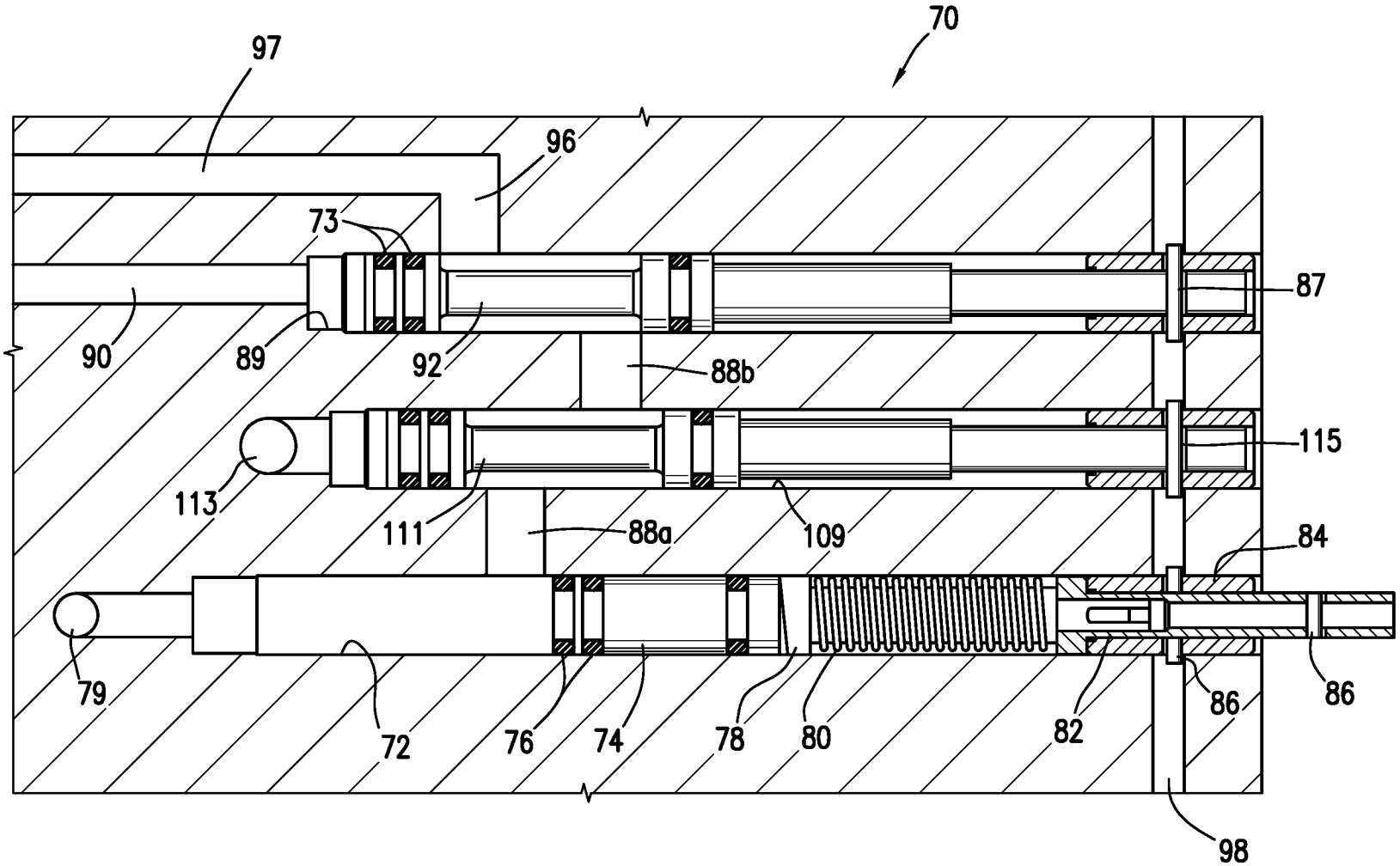
FIG. 3 depicts the valve arrangement of FIG. 2 in an inflate position.

In some embodiments, as depicted in FIGS. 2-6, valve collar 105 of the present disclosure may include a valve system such as valve assembly 70. Pressure applied to fluid in opening valve cylinder 72, which is in fluid communication with the pressure of the interior of mandrel 101 through valve port 79, acts on opening valve piston 74, which is sealed to opening valve cylinder 72 by seals 76. Opening valve cylinder 72 and opening valve piston 74 define an opening valve. The opening valve may have a closed position in which opening valve piston 74 is mechanically coupled to first temporary restraint 86. Temporary restraint, as used herein, may include, for example and without limitation, one or more of a frangible pin, frangible ring, shear pin, shear wire, shear screw or bolt, collet in detent groove, magnetic retainer, adhesive breakable under load, welding or brazing breakable under load, tensile stud breakable under load, or ball detent with spring. When the opening valve is in the closed position, opening valve piston 74 may close a flow path between the interior of mandrel 101 and first connecting port 88*a*. The opening valve may have an open position in which the flow path between the interior of mandrel 101 and first connecting port 88*a* is open. When valve assembly 70 is in a run-in position, as depicted in FIG. 2, opening valve may be in the closed position, such that opening valve piston 74 closes the flow path between the interior of mandrel 101 and the first connecting port 88*a*, closing the fluid path between the interior of mandrel 101 and packer body 103 of the inflatable packer (not shown). First temporary restraint 86 may have a first breaking force. Breaking force, as used herein, is the force applied to a temporary restraint required to cause the temporary restraint to release the elements the temporary restraint is coupling. For example, breaking force may correspond to the force required for mechanical failure of the respective shear pin, shear wire, adhesive bond, weld, etc. Breaking force may also correspond, for example, to the force required to shift a collet from a detent groove or a ball detent. The first breaking force may be selected to correspond to a first selected threshold pressure within the interior of mandrel 101 acting on opening valve piston 74. As pressure within the interior of mandrel 101 is increased, first temporary restraint 86—positioned in or corresponding with restraint slot 98—retains opening valve piston 74 in the closed position. Once the first selected threshold pressure is reached within the interior of mandrel 101 and opening valve cylinder 72, the differential pressure across opening valve piston 74 causes first temporary restraint 86 to release, allowing opening valve piston 74 to traverse within opening valve cylinder 72 such that the flow path between the interior of mandrel 101 and first connecting port 88*a* is opened, and the opening valve is in the open position as depicted in FIG. 3. In this position, referred to herein as the inflate position, fluid may flow from the interior of mandrel 101 to packer body 103 via first connecting port 88*a*, second connecting port 88*b*, output port 96, and inflation port 97. In some embodiments, opening valve piston 74 may traverse within opening valve cylinder 72 between end plug 84 and shear sleeve 82 as depicted in FIG. 3. In some embodiments, opening valve piston 74 may move such that seals 76 pass first connecting port 88*a*, compressing spring 80 on lock rod 78 and moving shear sleeve 82.

Figure 4:
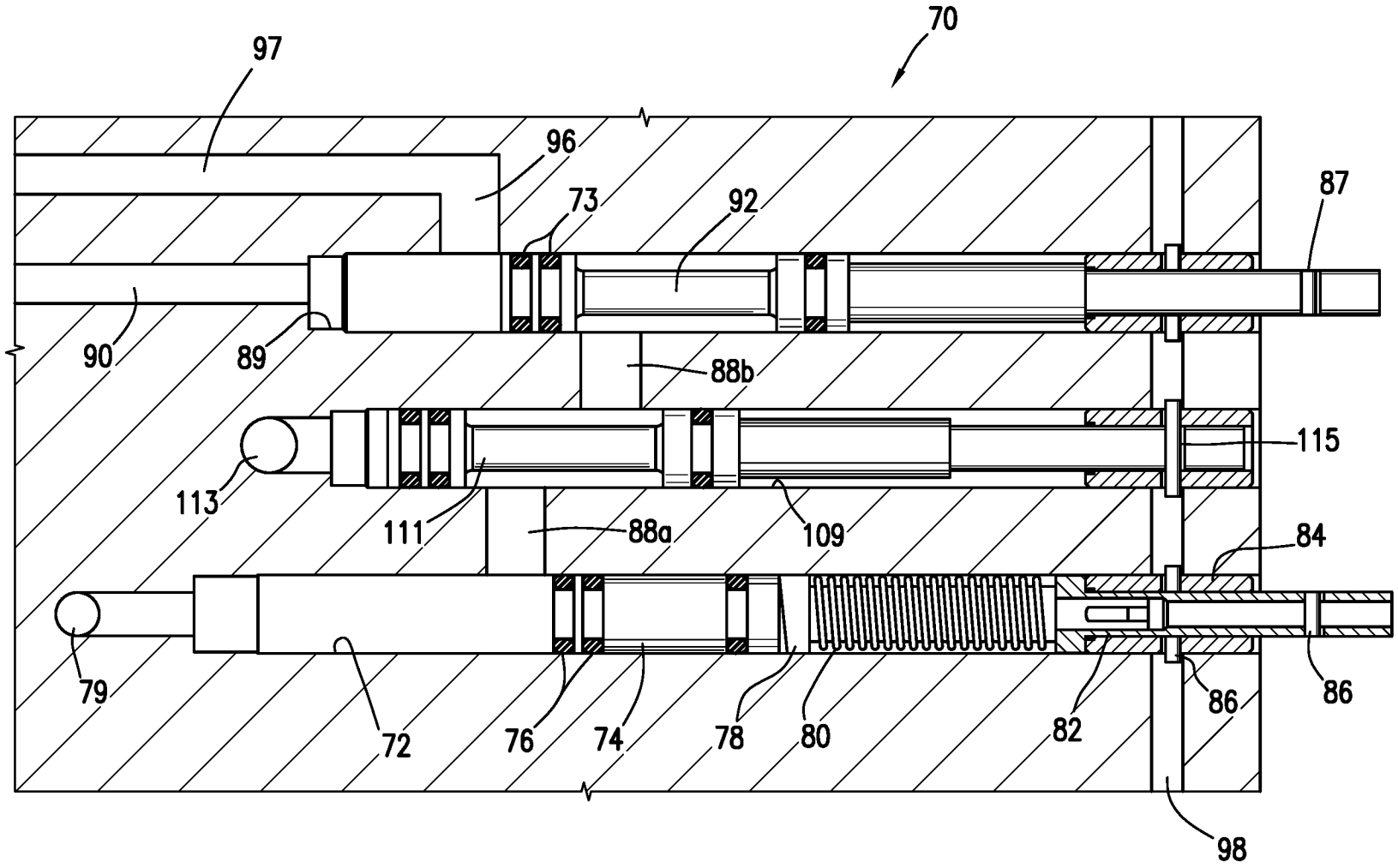
FIG. 4 depicts the valve arrangement of FIG. 2 in a full position.

Closing valve cylinder 89 includes closing valve piston 92. Closing valve cylinder 89 and closing valve piston 92 define a closing valve. The closing valve may have an open position in which closing valve piston 92 is mechanically coupled to second temporary restraint 87. When the closing valve is in the open position, a flow path between second connecting port 88*b* and output port 96, fluidly coupled to packer body 103, may be open. When the closing valve is in the closed position, closing valve piston 92 may close the flow path between second connecting port 88*b* and output port 96. When valve assembly 70 is in the run-in position depicted in FIG. 2 and the inflate position depicted in FIG. 3, the closing valve may be in the open position such that the flow path between the second connecting port 88*b* and output port 96 may be open. Second temporary restraint 87 may have a second breaking force. The second breaking force may be selected to correspond to a second selected threshold pressure within packer body 103 acting on closing valve piston 92 through closing port 90. The second selected threshold pressure may correspond to a desired set pressure of packer body 103. Closing port 90 may fluidly couple closing valve cylinder 89 with the interior of packer body 103. Once the packer reaches the second selected threshold pressure, the differential pressure across closing valve piston 92 causes second temporary restraint 87, located in temporary restraint slot 98, to release, allowing closing valve piston 92 to traverse within closing valve cylinder 89 such that the flow path between the second connecting port 88*b* and output port 96 is closed, and the closing valve is in the closed position as depicted in FIG. 4. In this position, referred to herein as the full position of valve assembly 70, the closing valve is in the closed position and retains the fluid within packer body 103. In some embodiments, closing valve piston 92 may traverse within closing valve cylinder 89 so that seals 73 move past output port 96, thereby closing the flow path between second connecting port 88*b* and output port 96.

Figure 5:
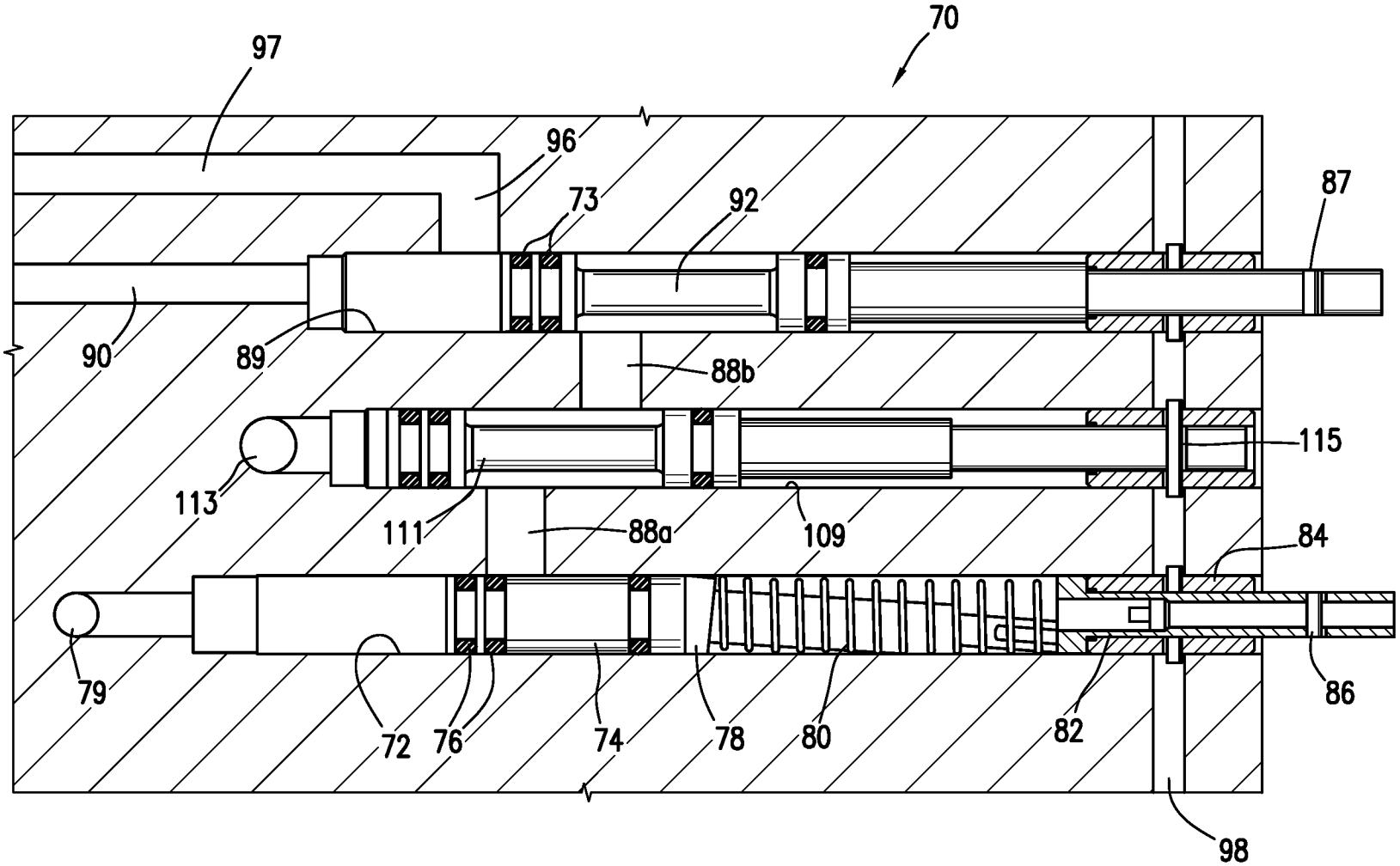
FIG. 5 depicts the valve arrangement of FIG. 2 in a locked position.

At this stage, the packer is fully inflated or set. By reducing the pressure within the interior of mandrel 101, opening valve piston 74 may be moved back to the closed position by spring 80 and may lock in the closed position by an outward cant of lock rod 78 as depicted in FIG. 5, referred to herein as the locked position. Opening valve piston 74 may close the flow path between the interior of mandrel 101 and first connecting port 88*a*, closing the opening valve.

In some embodiments, such as that depicted in FIGS. 2-6, lockout valve cylinder 109 may include lockout valve piston 111. Lockout valve cylinder 109 and lockout valve piston 111 define a lockout valve. The lockout valve may have an open position in which lockout valve piston 111 is mechanically coupled to third temporary restraint 115. When the lockout valve is in the open position, a flow path between first connecting port 88*a* and second connecting port 88*b* may be open. When the lockout valve is in the closed position, lockout valve piston 111 may close the flow path between first connecting port 88*a* and second connecting port 88*b*. When valve assembly 70 is in the run-in position depicted in FIG. 2, the lockout valve may be in the open position such that the flow path between the first connecting port 88*a* and the second connecting port 88*b* may be open. Third temporary restraint 115 may have a third breaking force. The third breaking force may be selected to correspond to a third selected threshold pressure within the interior of mandrel 101 acting on lockout valve piston 111 through lockout port 113. In some embodiments, the third selected threshold pressure may be greater than the first selected threshold pressure. During normal operation, such as that described herein above, the differential pressure between the interior of the mandrel 101 and the surrounding wellbore acting across lockout valve piston 111 may remain be lower than the third selected threshold pressure.

However, should the packer fail or rupture, fluid flow through valve assembly 70 may increase beyond that desired. Because the packer is ruptured, closing port 90 is exposed to the surrounding wellbore such that the closing valve remains in the open position. Closing valve piston 92 may not be able to function as described above to completely close off inflation port 97. Furthermore, without sufficient contact between the packer and the wellbore or surrounding tubular, fluid flow through valve assembly 70 caused by any differential pressure between the interior of mandrel 101 and the surrounding wellbore may prevent opening valve piston 74 from moving into the locked position depicted in FIG. 5. The flow path through valve assembly 70 and the ruptured packer may form an undesired opening from the interior of mandrel 101 to the surrounding wellbore. Continued fluid flow may additionally cause damage to valve assembly 70, valve collar 105, packer assembly 100, or the surrounding wellbore or tubular as valve assembly 70 remains in the inflate position depicted in FIG. 3.

Figure 6:
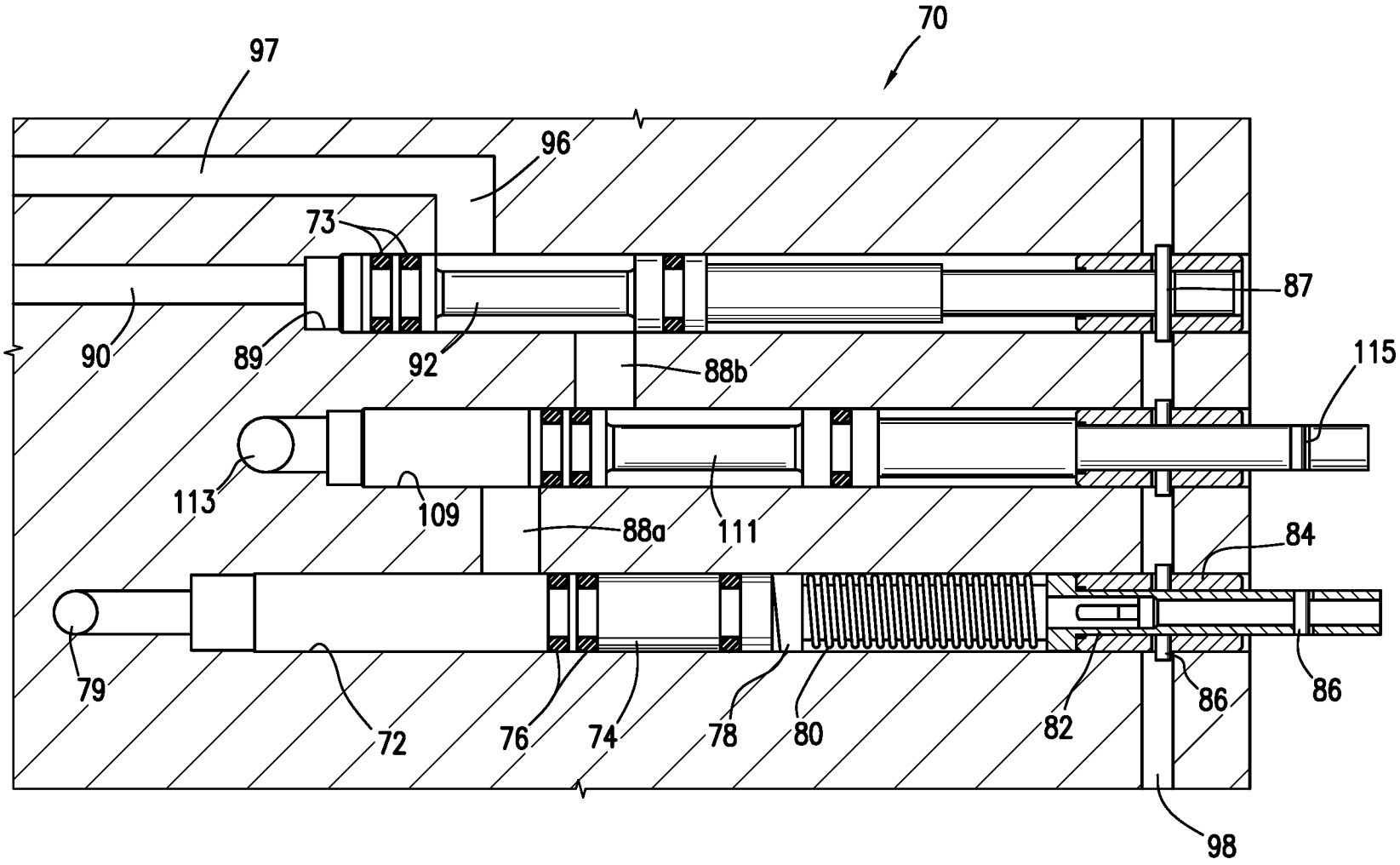
FIG. 6 depicts the valve arrangement of FIG. 2 in a lockout position.

In such an event, an operator may increase the pressure within mandrel 101 above the third selected threshold pressure, referred to herein as a pressure spike. The pressure spike may be created by, for example and without limitation, increasing the pump rate of a fluid pump at the surface (not shown). The pressure spike may increase the pressure within mandrel 101 above the third selected threshold pressure. The pressure spike may increase the differential pressure across lockout valve piston 111 above the third selected threshold pressure, causing the third temporary restraint 115 to release, allowing lockout valve piston 111 to traverse within the lockout valve cylinder 109 such that the flow path between first connecting port 88*a* and second connecting port 88*b* is closed, and the lockout valve is in the closed position as depicted in FIG. 6. In this position, referred to herein as the lockout position of valve assembly 70, the lockout valve is in the closed position, closing the flow path between the interior of the mandrel and packer body 103 by closing the flow path between first connecting port 88*a* and second connecting port 88*b*. In some embodiments, lockout valve piston 111 may traverse from the open position depicted in FIG. 3, 4 to the closed position depicted in FIG. 6. Once in the closed position, at least a portion of lockout valve piston 111 may be positioned within lockout valve cylinder 109 between first connecting port 88*a* and second connecting port 88*b*, blocking fluid flow therebetween.

One having ordinary skill in the art with the benefit of this disclosure will understand that although described as being actuated when in the full position, lockout valve piston 111 may be actuated at other times by increasing the pressure in the interior of the mandrel 101 above the third selected threshold pressure. For example and without limitation, lockout valve piston 111 may be actuated if opening valve piston 74 fails to lock or if closing valve piston 92 fails to close. Additionally, although a specific valve configuration is disclosed herein, one having ordinary skill in the art with the benefit of this disclosure will understand that lockout valve cylinder 109 and lockout valve piston 111 may be incorporated into any other valve configuration without deviating from the scope of this disclosure. For example, opening valve piston 74 may omit the locking mechanism without deviating from the scope of this disclosure.

In at least one embodiment of the present disclosure, valve assembly 70, and specifically closing valve cylinder 89, opening valve cylinder 72, and lockout valve cylinder 109 may be formed by, for example and without limitation, drilling, boring, electrical discharge machining (EDM), or any combination of known techniques.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A fluid actuated packer and collar assembly comprising:

a packer comprising a packer body;

a valve assembly fluidly coupled to the packer body, the valve assembly including a flow path therethrough, the flow path including elements comprising an opening valve cylinder, a first connecting port, a lockout valve cylinder; a second connecting port, a closing valve cylinder, and an inflation port, wherein the elements of the flow path are fluidly connected in the order recited so as to define a fluid flow path from the opening valve cylinder to the inflation port;

wherein the valve assembly comprises:

an opening valve, the opening valve comprising the opening valve cylinder and an opening valve piston, the opening valve having a closed position wherein the opening valve piston is restrained by a first temporary restraint and the opening valve piston closes a flow path to the first connecting port, and the opening valve having an open position wherein the opening valve piston is not restrained by the first temporary restraint and the flow path to the first connecting port is open;

a closing valve, the closing valve comprising the closing valve cylinder and a closing valve piston, the closing valve having an open position wherein the closing valve piston is restrained by a second temporary restraint and a flow path between the second connecting port and the inflation port is open, and the closing valve having a closed position wherein the closing valve piston is not restrained by the second temporary restraint and closes the flow path between the second connecting port and inflation port; and a lockout valve, the lockout valve comprising the lockout valve cylinder and a lockout valve piston, the lockout valve having an open position wherein the lockout valve piston is restrained by a third temporary restraint and a flow path between the first and second connecting ports is open, and the lockout valve having a closed position wherein the lockout valve piston is not restrained by the third temporary restraint and closes the flow path between the first and second connecting ports.

2. The packer and collar assembly of claim 1 wherein the valve assembly has a run-in position wherein the opening valve is in the closed position, the closing valve is in the open position, and the lockout valve is in the open position.

3. The packer and collar assembly of claim 1 wherein the valve assembly has an inflate position wherein the opening valve, the closing valve, and the lockout valve are each in the open position.

4. The packer and collar assembly of claim 1 wherein the valve assembly has a full position wherein the opening valve and the lockout valve are each in the open position and the closing valve is in the closed position.

5. The packer and collar assembly of claim 1 wherein the valve assembly has a locked position wherein the opening valve and the closing valve are each in the closed position, and the lockout valve is in the open position.

6. The packer and collar assembly of claim 5 wherein the opening valve further comprises a spring positioned to bias the opening valve piston into the closed position.

7. The packer and collar assembly of claim 6 wherein the opening valve further comprises a lock rod, the lock rod positioned within the opening valve cylinder such that when the opening valve piston is biased into the closed position by the spring, the lock rod cants to lock the opening valve piston in the closed position.

8. The packer and collar assembly of claim 1 wherein the valve assembly has a lockout position wherein the lockout valve is in the closed position and wherein the opening valve and the closing valve are each in the open position.

9. The packer and collar assembly of claim 1 wherein the first temporary restraint has a first breaking force corresponding to a first selected threshold pressure acting on the opening valve piston, the second temporary restraint has a second breaking force corresponding to a second threshold pressure acting on the closing valve piston, and the third temporary restraint has a third breaking force corresponding to a third threshold pressure acting on the lockout valve piston.

10. The packer and collar assembly of claim 9 wherein the first breaking force is lower than the third breaking force.

11. The packer and collar assembly of claim 1 wherein the first, second, and third temporary restraints include one or more of a frangible pin, frangible ring, shear pin, shear wire, shear screw or bolt, collet in detent groove, magnetic retainer, adhesive breakable under load, welding or brazing breakable under load, tensile stud breakable under load, or ball detent with spring.

12. A method comprising:

a) positioning a packer and collar assembly in a wellbore, the packer and collar assembly comprising:

a packer comprising a packer body; and a valve assembly fluidly coupled to the packer body, the valve assembly comprising:

an opening valve, the opening valve comprising an opening valve cylinder and an opening valve piston, the opening valve having a closed position wherein the opening valve piston is restrained by a first temporary restraint and the opening valve piston closes a flow path between an interior of a mandrel and a first connecting port, and the opening valve having an open position wherein the opening valve piston is not restrained by the first temporary restraint and the flow path between the interior of the mandrel and the first connecting port is open, the first temporary restraint having a first breaking force corresponding to a first selected threshold pressure acting on the opening valve piston;

a closing valve, the closing valve comprising a closing valve cylinder and a closing valve piston, the closing valve having an open position wherein the closing valve piston is restrained by a second temporary restraint and a flow path between a second connecting port and the packer body is open, and the closing valve having a closed position wherein the closing valve piston is not restrained by the second temporary restraint and the closing valve piston closes the flow path between the second connecting port and the packer body, the second temporary restraint having a second breaking force corresponding to a second threshold pressure acting on the closing valve piston; and a lockout valve, the lockout valve comprising a lockout valve cylinder and a lockout valve piston, the lockout valve having an open position wherein the lockout valve piston is restrained by a third temporary restraint and a flow path between the first connecting port and the second connecting port is open, and the lockout valve having a closed position wherein the lockout valve piston is not restrained by the third temporary restraint and the lockout valve piston closes the flow path between the first connecting port and the second connecting port, the third temporary restraint having a third breaking force corresponding to a third threshold pressure acting on the lockout valve piston;

wherein the opening valve is closed and the closing valve and the lockout valve are open during step a);

b) increasing a pressure in the interior of the mandrel above the first selected threshold pressure;

c) breaking the first temporary restraint;

d) opening the opening valve;

e) flowing fluid through the valve assembly to the packer body through the first connecting port and the second connecting port; and f) inflating the packer body.

13. The method of claim 12, further comprising:

g) increasing the pressure in the packer body above the second selected threshold pressure;

h) breaking the second temporary restraint; and i) allowing a pressure in the packer body to close the closing valve.

14. The method of claim 13, further comprising:

j) reducing the pressure in the interior of the mandrel;

k) biasing the opening valve piston to close the flow to the first connecting port; and l) closing the opening valve.

15. The method of claim 14 wherein the opening valve further comprises a lock rod, and the method further comprises:

canting the lock rod within the opening valve cylinder; and locking the opening valve in the closed position.

16. The method of claim 12, further comprising:

increasing the pressure in the interior of the mandrel above the third selected threshold pressure;

breaking the third temporary restraint; and allowing a pressure in the mandrel to close the lockout valve.

17. The method of claim 16 wherein increasing the pressure in the interior of the mandrel above the third selected threshold pressure comprises increasing a pump rate of one or more fluid pumps.

18. The method of claim 12 wherein the first, second, and third temporary restraints include one or more of a frangible pin, frangible ring, shear pin, shear wire, shear screw or bolt, collet in detent groove, magnetic retainer, adhesive breakable under load, welding or brazing breakable under load, tensile stud breakable under load, or ball detent with spring.

* * * * *